US008091627B2

(12) United States Patent
Hall et al.

(10) Patent No.: US 8,091,627 B2
(45) Date of Patent: Jan. 10, 2012

(54) STRESS RELIEF IN A POCKET OF A DOWNHOLE TOOL STRING COMPONENT

(76) Inventors: David R. Hall, Provo, UT (US); Scott Dahlgren, Alpine, UT (US); Paula Turner, Pleasant Grove, UT (US)

( * ) Notice: Subject to any disclaimer, the term of this patent is extended or adjusted under 35 U.S.C. 154(b) by 199 days.

(21) Appl. No.: 12/624,292

(22) Filed: Nov. 23, 2009

(65) Prior Publication Data

US 2011/0120701 A1 May 26, 2011

(51) Int. Cl.
*E21B 17/00* (2006.01)

(52) U.S. Cl. ..... 166/65.1; 166/242.1

(58) Field of Classification Search ..... 166/65.1, 166/66, 250.11, 242.1
See application file for complete search history.

(56) References Cited

U.S. PATENT DOCUMENTS 1,817,772 A 8/1931 Sipe
1,977,175 A 10/1934 Davis
2,066,473 A 1/1937 Jorgensen
2,325,811 A 8/1943 Terrell
2,354,887 A 8/1944 Silverman
2,664,272 A 12/1953 Bolce
2,676,820 A 4/1954 Bolce
2,999,552 A 9/1961 Fox
3,079,549 A 2/1963 Martin
3,085,939 A 4/1963 Fitch
3,125,173 A 3/1964 Fox
3,146,611 A 9/1964 Fox
3,175,374 A 3/1965 Toelke
3,186,222 A 6/1965 Martin
3,194,331 A 7/1965 Arnold
3,338,069 A 8/1967 Ortioff
3,380,960 A 4/1968 Massey
3,554,307 A 1/1971 Yount
3,606,402 A 9/1971 Medney
3,773,359 A 11/1973 Chance
3,793,632 A 2/1974 Still
3,876,972 A 4/1975 Garrett
3,903,974 A 9/1975 Cullen
3,968,473 A 7/1976 Patton
4,204,707 A 5/1980 Lincicome
4,215,426 A 7/1980 Klatt
4,328,704 A 5/1982 Arpasi
4,365,678 A 12/1982 Fitch
4,460,202 A 7/1984 Chance
4,479,564 A 10/1984 Tanguy
4,683,944 A 8/1987 Curlett
4,722,402 A 2/1988 Weldon
4,785,247 A 11/1988 Meador
4,811,597 A 3/1989 Hebel
4,811,800 A 3/1989 Hill
4,892,337 A 1/1990 Gunderson
5,039,137 A 8/1991 Cankovic
5,040,620 A 8/1991 Nunley
5,040,622 A 8/1991 Winship
5,248,857 A 9/1993 Ollivier
5,334,801 A 8/1994 Mohn
5,563,512 A * 10/1996 Mumby ..... 324/339
(Continued)

*Primary Examiner* — William P Neuder
(74) *Attorney, Agent, or Firm* — Philip W. Townsend, III

(57) ABSTRACT

A downhole tool string component has a tubular body with an inner and outer diameter. A pocket is formed in the outer diameter and is adapted to receive downhole instrumentation. A covering is attached to the outer diameter of the component and is adapted to seal the pocket from outside debris, the pocket having a bottom floor and a plurality of side walls. A stress relief is formed in the pocket.

19 Claims, 9 Drawing Sheets

U.S. PATENT DOCUMENTS 5,691,712 A 11/1997 Meek
5,988,276 A 11/1999 Oneal
6,012,744 A 1/2000 Wilson
6,026,897 A 2/2000 Pringle
6,655,452 B2 12/2003 Zillinger
6,851,489 B2 2/2005 Hinds
6,896,049 B2 5/2005 Moyes
7,048,063 B2 * 5/2006 Cameron ..... 166/381
7,377,315 B2 * 5/2008 Hall et al. ..... 166/242.1
2003/0070842 A1 4/2003 Bailey
2003/0131992 A1 * 7/2003 Michael et al. ..... 166/255.2
2003/0137429 A1 * 7/2003 Clark et al. ..... 340/854.5
2003/0147360 A1 * 8/2003 Nero et al. ..... 370/314
2004/0184871 A1 9/2004 Luft
2005/0189947 A1 * 9/2005 Haugland ..... 324/338
2005/0257961 A1 * 11/2005 Snell et al. ..... 175/40

* cited by examiner

STRESS RELIEF IN A POCKET OF A DOWNHOLE TOOL STRING COMPONENT

BACKGROUND OF THE INVENTION

Recent advances in downhole telemetry systems have enable high speed communication between downhole devices and the earth's surface. With these high speed communication abilities, more downhole devices may be utilized in downhole applications. Harsh downhole environments may subject downhole devices to extreme temperatures and pressures. Further, drilling and/or production equipment may be subjected to potentially damaging forces, such as tensile loads from the weight of the drill string, bending, thermal expansion, vibration, and torque from the rotation of a drill string.

U.S. Patent Publications 2005/0161215 and 2005/0001735, both to Hall, et al; which are both incorporated herein by reference for all that they contain; disclose a connection for retaining electronic devices within a bore of a downhole tool. The connection transfers a portion of the makeup load away from the electronic devices.

U.S. Pat. No. 6,075,461 issued Jun. 13, 2000 to Smith discloses an apparatus, method and system for communicating information between downhole equipment and surface equipment. An electromagnetic signal repeater apparatus comprises a housing that is securably mountable to the exterior of a pipe string disposed in a well bore. The housing includes first and second housing subassemblies. The first housing subassembly is electrically isolated from the second housing subassembly by a gap subassembly having a length that is at least two times the diameter of the housing. The first housing subassembly is electrically isolated from the pipe string and is secured thereto with a nonconductive strap. The second housing subassembly is electrically coupled with the pipe string and is secured thereto with a conductive strap. An electronics package and a battery are disposed within the housing. The electronics package receives, processes, and retransmits the information being communicated between the downhole equipment and the surface equipment via electromagnetic waves.

U.S. Pat. No. 6,655,452 issued Dec. 2, 2003 to Zillinger discloses a carrier apparatus for connection with a pipe string for use in transporting at least one gauge downhole through a borehole. The apparatus includes a tubular body for connection with the pipe string having a bore for conducting a fluid therethrough and an outer surface, wherein the outer surface has at least one longitudinal recess formed therein. Further, at least one insert defining an internal chamber for receiving a gauge is mounted with the body such that at least a portion of the insert is receivable within the recess for engagement therewith. The apparatus also includes an interlocking interface comprised of the engagement between the insert and the recess, wherein the interlocking interface is configured such that the insert inhibits radial expansion of the body adjacent the recess.

BRIEF SUMMARY OF THE INVENTION

In one aspect of the invention, a downhole tool string component has a tubular body with an inner and outer diameter. A pocket is formed in the outer diameter and is adapted to receive downhole instrumentation. A covering is attached to the outer diameter of the component and is adapted to seal the pocket from outside debris, the pocket having a bottom floor and a plurality of side walls. A stress relief is formed in at least one of the side walls.

The pocket may be annular and may encompass the entire outer diameter. A plurality of pockets may be formed in the outer diameter and may be adapted to receive downhole instrumentation. The side walls may be sloped. A plurality of open cavities may be formed in at least one of the side walls. The stress relief may be formed in a plurality of the side walls. The stress relief may comprise a step with a rounded geometry. The stress relief may comprise rounded borders. The stress relief may be generally concave. The stress relief may comprise a convex portion. A ratio of a depth of the stress relief to a depth of the pocket ranges between 0.2 to 1, and 1.5 to 1.

A portion of the downhole instrumentation may be disposed within the stress relief. A portion of an electrically conductive conduit in electrical communication with the downhole instrumentation may be disposed within the stress relief. The electrically conductive conduit may be in electrical communication with surface equipment. The downhole instrumentation may be part of a closed-loop system.

The covering may be adapted to seal the plurality of pockets from outside debris. The covering may be a sleeve disposed around the outer diameter of the tubular body. The covering may be a plate fastened to the outer diameter of the tubular body. The covering may comprise a plurality of grooves adapted to stretch and/or flex with the tubular body. The tubular body may be selected from the group consisting of drill pipe, drill collars, reamers, subs, swivels, production pipe, injector pipe, horizontal drilling pipe, jars, hammers, stabilizers, or combinations thereof.

DETAILED DESCRIPTION OF THE INVENTION AND THE PREFERRED EMBODIMENT

Figure 1:
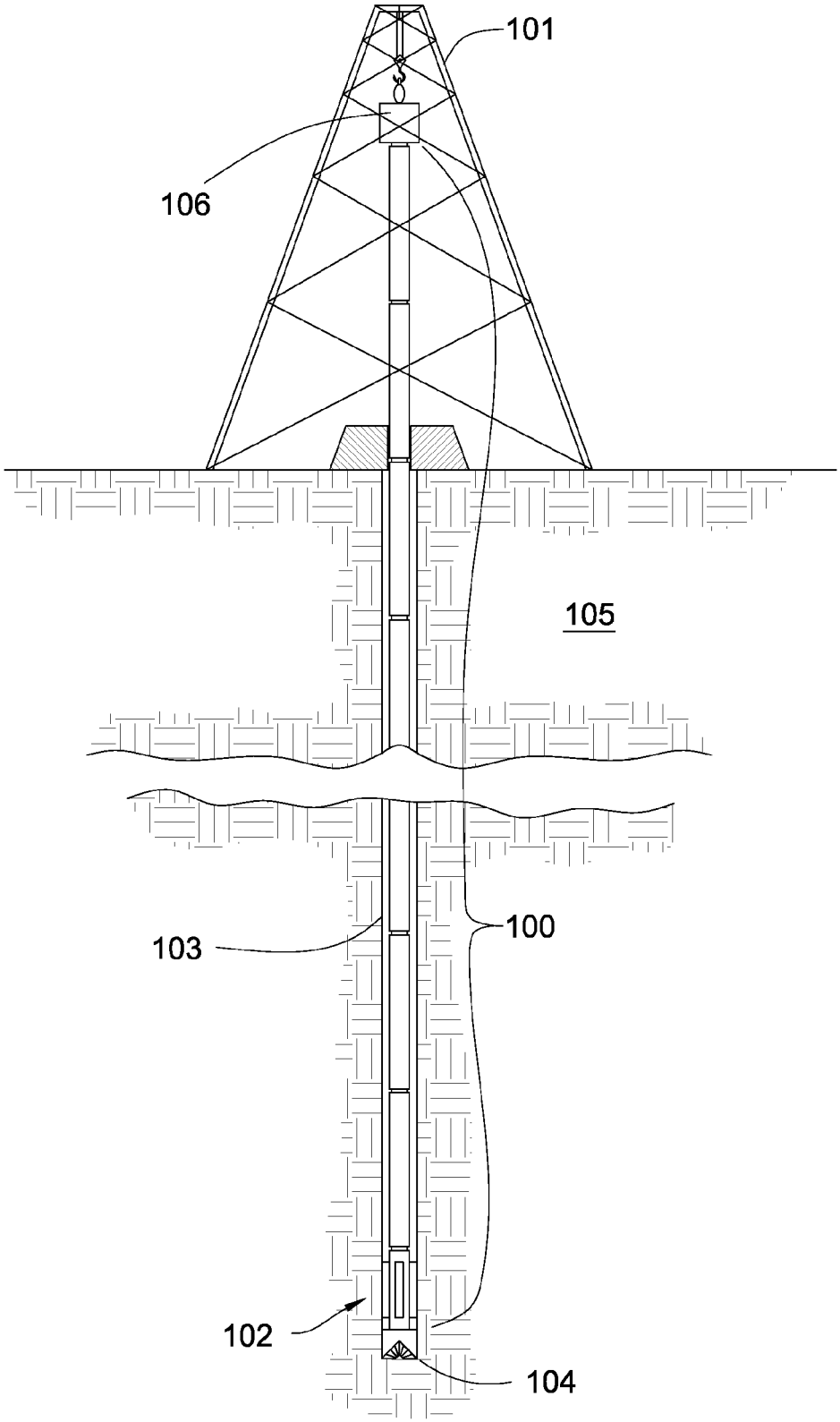
FIG. 1 is a cross-sectional diagram of an embodiment of a tool string suspended in a bore hole.

FIG. 1 is an embodiment of a tool string 100 suspended by a derrick 101. A bottom hole assembly 102 is located at the bottom of a bore hole 103 and comprises a drill bit 104. As the drill bit 104 rotates downhole the tool string 100 advances farther into the earth. The tool string may penetrate soft or hard subterranean formations 105. The bottom-hole assembly 102 and/or downhole components may comprise data acquisition devices which may gather data. The data may be sent to the surface via a transmission system to a data swivel 106. The data swivel 106 may send the data to the surface equipment. Further, the surface equipment may send data and/or power to downhole tools and/or the bottom-hole assembly 102.

Figure 2:
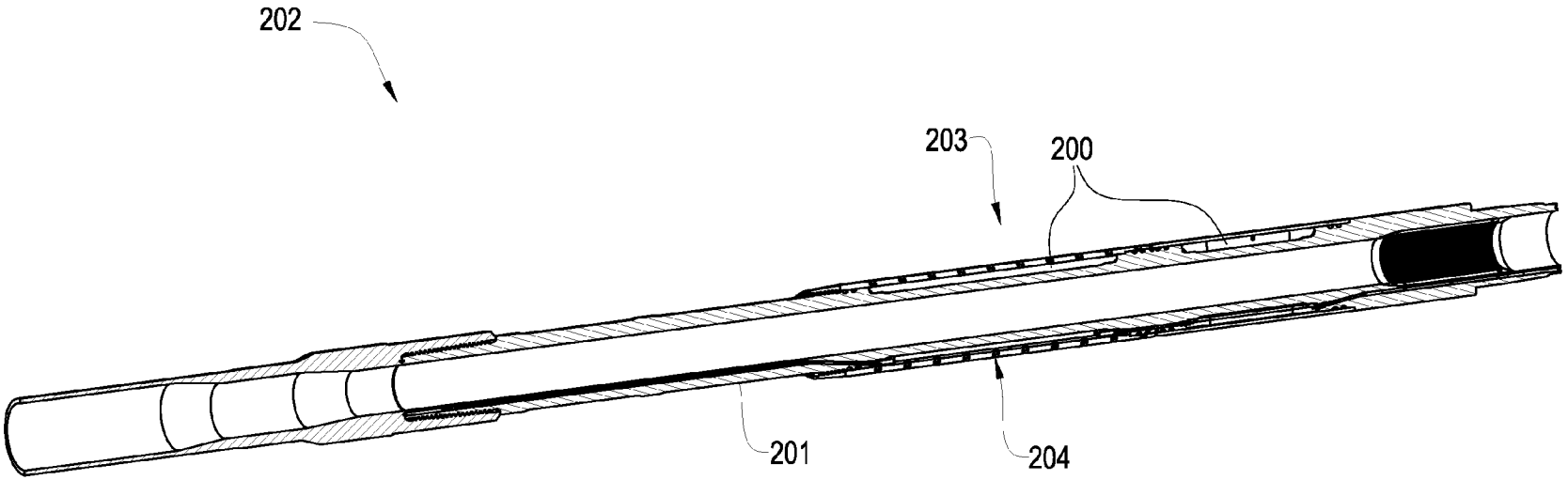
FIG. 2 is a cross-sectional diagram of an embodiment of a downhole tool string component.

Electronic equipment and/or other downhole instrumentations may be disposed within the downhole tools, as in the embodiment of FIG. 2. The electronic equipment may be disposed within pockets 200 formed in an outer diameter 201 of a downhole tool string component 202. The pockets 200 may be covered and protected by a covering such as a sleeve 203. The sleeve 203 may be a compliant, metal sleeve, such as is disclosed in U.S. patent application Ser. No. 11/164,572, which is herein incorporated by reference for all that it contains. The sleeve 203 forms a seal over the pockets 200 such that debris and drilling fluids cannot enter the pockets, protecting the electronic equipment from drilling mud and other materials which may damage them. The sleeve 203 may comprise a plurality of grooves 204 adapted to allow the sleeve 203 to stretch and/or flex with the component 202, which may be particularly useful in directional drilling operations.

The electronic equipment may comprise batteries, logic circuits, sensors, or other electronics suitable for downhole environments. The batteries may be used to power other downhole electronics or motors. The sensors may include pressure sensors, strain sensors, flow sensors, acoustic sensors, temperature sensors, torque sensors, position sensors, vibration sensors, or any combination thereof for monitoring conditions of the tool string component 202 or conditions in the bore hole. The logic circuits may be used to control a closed-loop system in one or more downhole components.

Figure 3:
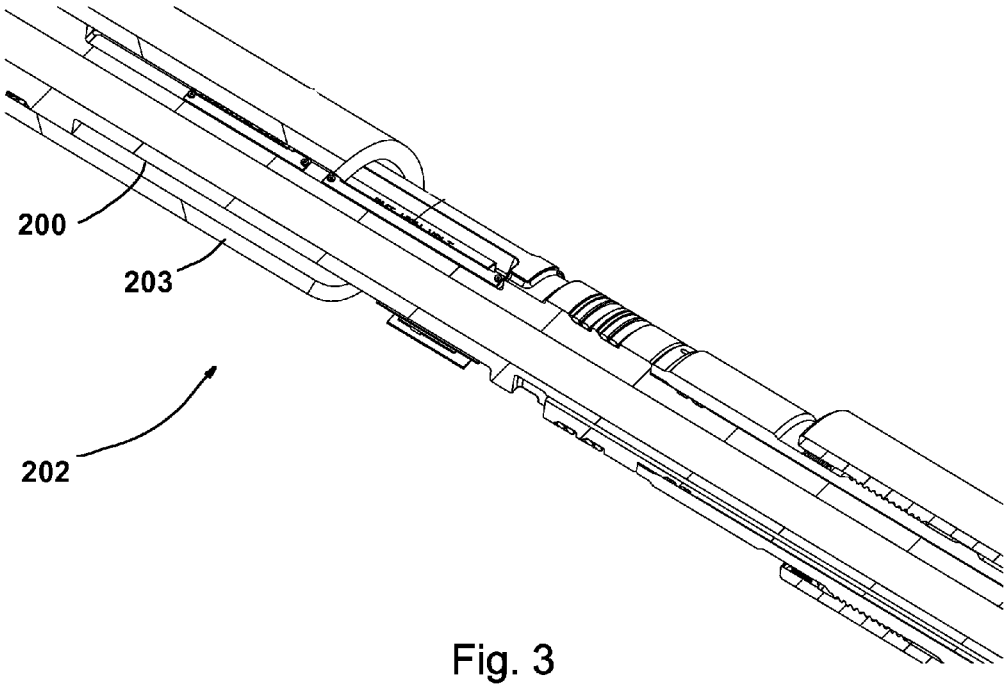
FIG. 3 is a cross-sectional diagram of an embodiment of a downhole tool string component.

FIG. 3 discloses electronic equipment residing with a pocket of a downhole tool string component 202. The sleeve 203 is adapted to slide over the pocket 200 and protect the equipment.

Figure 4:
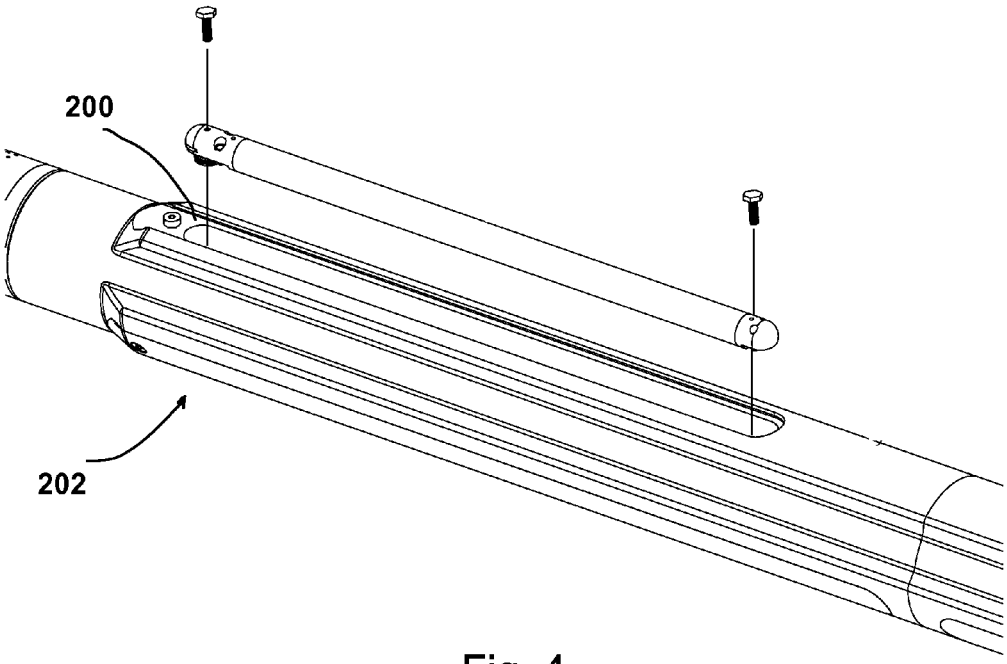
FIG. 4 is a cross-sectional diagram of an embodiment of a downhole tool string component.

FIG. 4 discloses a electronic equipment that is secured into a pocket of a downhole tool string component 202 where the pocket 200 is formed on the outer surface of the component. The equipment may be bolted or other wise attached within the pocket, and a cover may be secured over the pocket to protect its contents from the downhole drilling environment.

Figure 5:
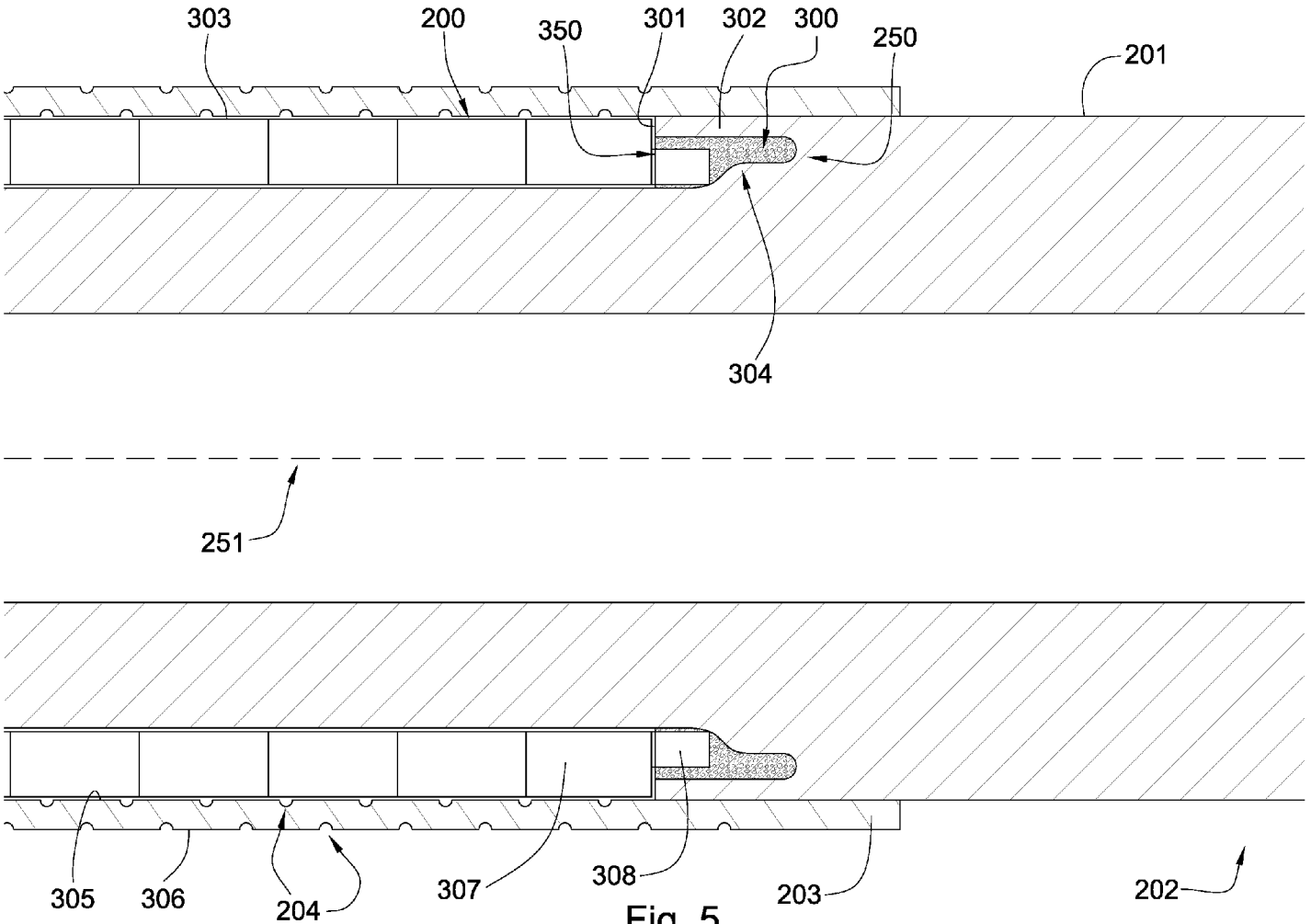
FIG. 5 is a cross-sectional diagram of an embodiment of a pocket in a downhole tool string component.

At least one of the pockets 200 may comprise an stress relief 300 formed in a side wall 301 of the pocket 200, as in the embodiment of FIG. 5, with an overhanging portion 302 of the component between the stress relief 300 and the outer diameter 201. Right angles joining a bottom floor 303 of the pocket 200 with the side wall 301 may cause stress risers in the downhole component 202, which may cause the component 202 to crack or weaken. The stress relief may comprise a characteristic of adding flexibility to the downhole tool string component. The added flexibility may be along the axis 251 of the downhole tool string component. In addition to adding flexibility to the component, it may also shorten the pocket size, since the same amount of electronics may be disposed within a smaller pocket with the stress relief.

The stress relief 300 preferably comprises rounded borders in order to reduce the number of stress risers in the component 200. The rounded portions may comprise a radius or conic from 0.125 inches to 1 inch. The rounded portions may also comprise a conic form factor where 0.5 point to point and 1 is point to intersect and v(2)/2 defining a round our concave conic form factors may have a range from 0.6 to 0.9. The stress relief 300 may comprise a step 304 up from the bottom floor 303 with a rounded geometry in order to distribute torque and other forces across a larger area.

The stress relief may be a closed cavity, a recess or groove that prevents stress from concentrating at the junction of the pocket wall and floor.

A filler material 360 is fitted within the stress relief which supports the overhang from the ambient downhole pressure. The filler material may be made out of steel and comprise a geometry which approximates the geometry of the stress relief. Other suitable filler materials may be carbide, titanium, rubber, ceramics, metals, composites, or combinations thereof.

The sleeve 203 may comprise grooves 204 on both an inner and outer surface 305, 306, making it more compliant to stretching and bending. Electronics may be disposed within hard casings 307 within the pocket 200 such that the electronics may be protected from jostling, vibrating, or pressure from the bore in addition to the protection given by the sleeve 203. A portion 308 of the electronics or downhole instrumentation may be disposed within the stress relief 300. This may help anchor the electronics within the pocket 200. Sensors may also be disposed within the stress relief or within another part of the pocket 200, which may aid in monitoring the amount of torque or pressure applied to the overhanging portion 302 or the sleeve 203. The stress relief may also comprise a back end 250. The back end 250 is the portion of the stress relief 300 located generally farthest from an opening 350 of the stress relief 300.

Figure 6:
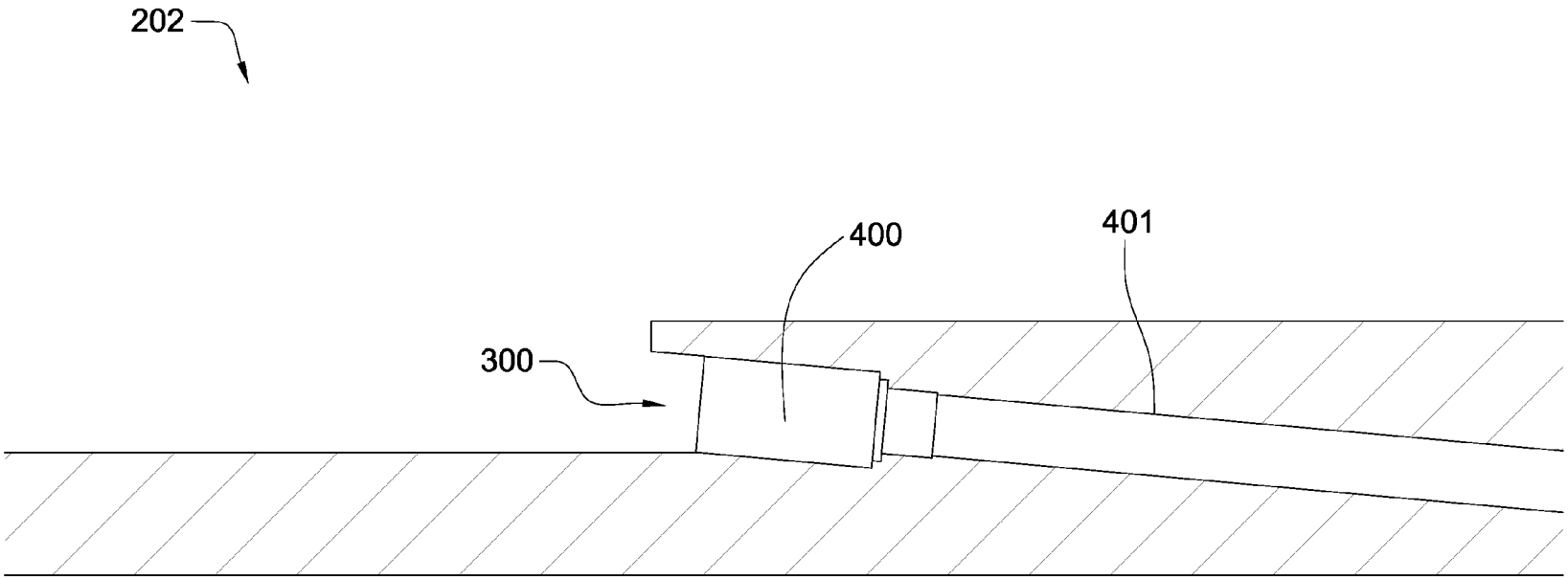
FIG. 6 is a cross-sectional diagram of another embodiment of a pocket in a downhole tool string component.

A portion of an electrically conductive conduit 400 may be disposed within the stress relief 300, as in the embodiment of FIG. 6, and may protrude from the back end 250 of the stress relief 300. The conduit may comprise a coaxial cable, twisted pair of wires, copper wires, fiber optic lines, or combinations thereof. The conduit 400 may extend into the stress relief 300 from a bore 401 in the wall of the component 202 and be in electrical communication with the downhole instrumentation. The conduit 401 may extend through a length of the component 202 to be connected to other downhole instruments, or it may connect to an electrically conductive conduit in an adjacent tool string component.

The conduit 401 may be part of a downhole electrical transmission system. A suitable transmission system for the current invention is disclosed in U.S. Pat. No. 6,670,880 to Hall, which is herein incorporated by reference for all that it contains. The transmission system may be capable of transmitting data and power to the downhole instrumentation simultaneously through the transmission system, either from the surface or from another component in the drill string.

Figure 7:
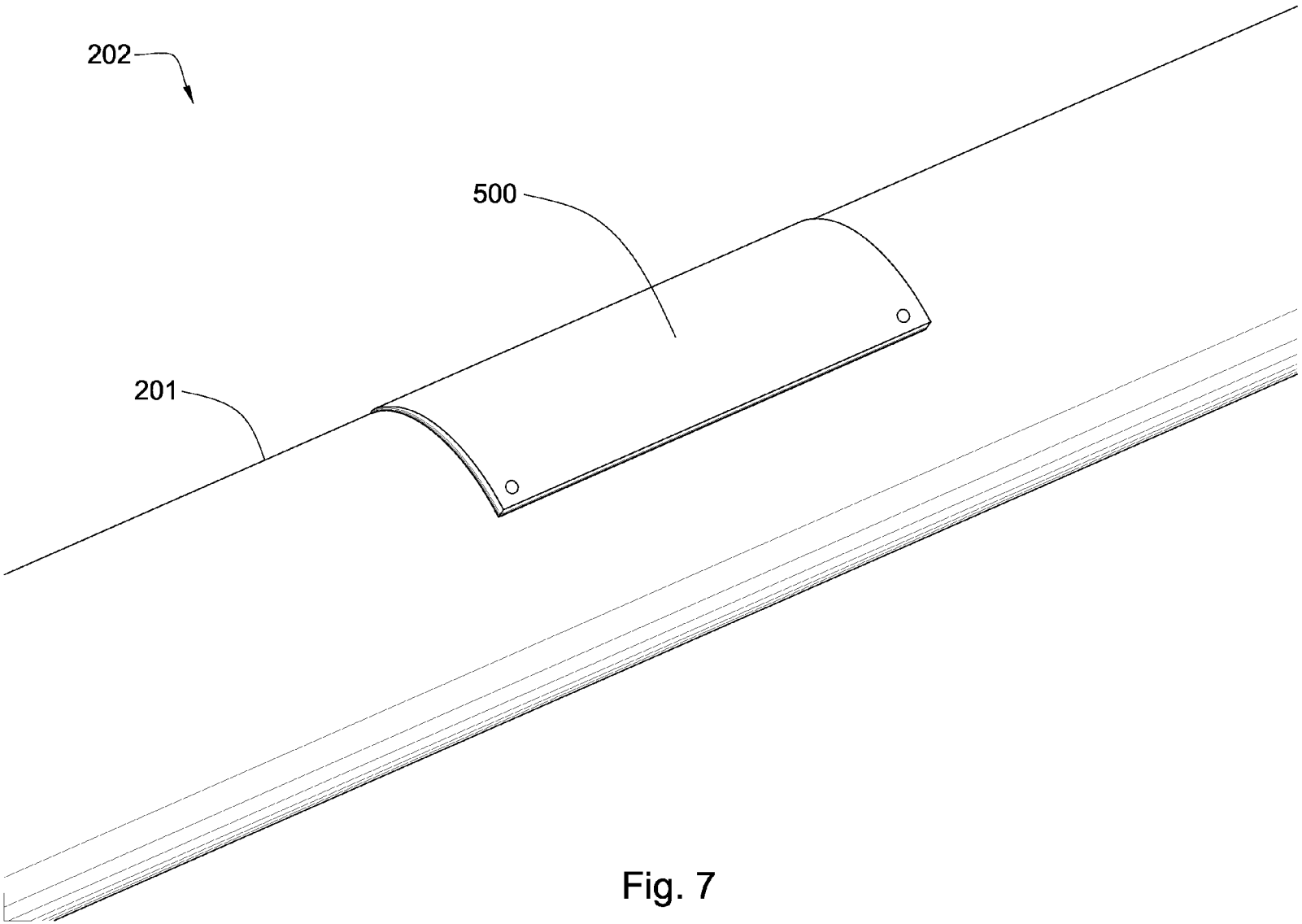
FIG. 7 is a perspective diagram of another embodiment of a downhole tool string component.

The covering may be a curved plate 500 fastened to the component 202, as in the embodiment of FIG. 7. The plate 500 may be a metal durable enough to resist wear due to downhole conditions and flexible enough to stretch or bend with the component 202. The plate 500 may or may not be disposed around the entire outer diameter 201 of the component 202, depending on the size of the pocket.

The plate 500 may be fastened to the outer diameter 201 of the component, or it may be fastened within a recess formed in the outer diameter 201 and surrounding the pocket. An upper surface of the plate 500 may be flush with the outer diameter 201 of the component 202. This may prevent the plate 500 from catching on the formation while drilling or removing the drill string from the bore hole 103.

Figure 8:
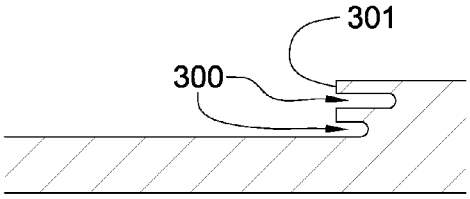
FIG. 8 is a cross-sectional diagram of another embodiment of a pocket in a downhole tool string component.
Figure 12:
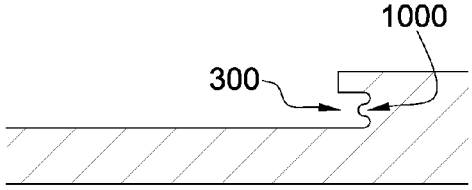
FIG. 12 is a cross-sectional diagram of another embodiment of a pocket in a downhole tool string component.
Figure 9:
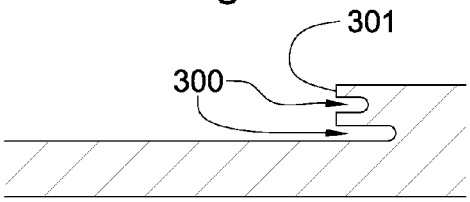
FIG. 9 is a cross-sectional diagram of another embodiment of a pocket in a downhole tool string component.
Figure 13:
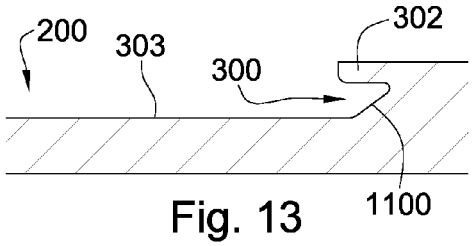
FIG. 13 is a cross-sectional diagram of another embodiment of a pocket in a downhole tool string component.
Figure 10:
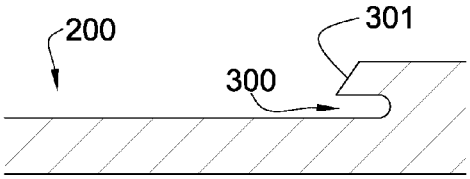
FIG. 10 is a cross-sectional diagram of another embodiment of a pocket in a downhole tool string component.
Figure 14:
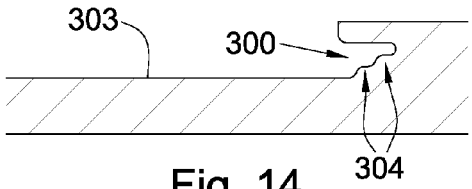
FIG. 14 is a cross-sectional diagram of another embodiment of a pocket in a downhole tool string component.
Figure 11:
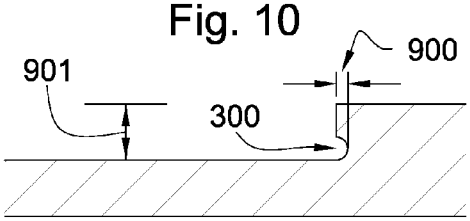
FIG. 11 is a cross-sectional diagram of another embodiment of a pocket in a downhole tool string component.
Figure 15:
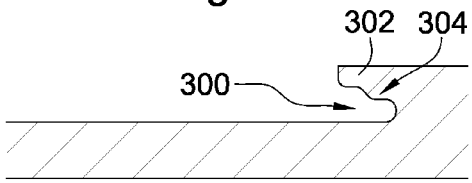
FIG. 15 is a cross-sectional diagram of another embodiment of a pocket in a downhole tool string component.
Figure 16:
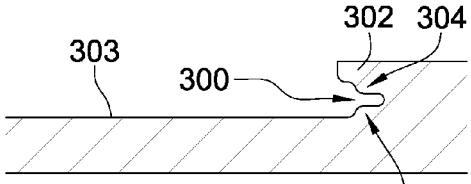
FIG. 16 is a cross-sectional diagram of another embodiment of a pocket in a downhole tool string component.

The side wall 301 may comprise a plurality of open cavities 300, as in the embodiments of FIGS. 8 and 9. The cavities 300 may comprise equal or different depths. The stress relief 300 may be formed straight into the side wall 301, as in the embodiment of FIG. 10. The side wall 301 may also be sloped at any angle with respect to the bottom floor 303 of the pocket 200. The stress relief 300 may simply be a small concave recess, with a ratio of the depth 900 of the stress relief to a depth 901 of the pocket being as low as 0.2 to 1, as in the embodiment of FIG. 11, though in some embodiments the ratio may be as high as 1.5 to 1. The stress relief 300 may comprise a convex portion 1000, as in the embodiment of FIG. 12. The stress relief 300 may comprise a sloped portion 1100 up from the bottom floor 303 of the pocket 200, as in the embodiment of FIG. 13, or from the overhanging portion 302. The stress relief 300 may comprise a plurality of successive steps 304 up from the bottom floor 303, as in the embodiment of FIG. 14, preferably comprising rounded geometries. The stress relief 300 may comprise a step 304 from the overhanging portion 302, as in the embodiment of FIG. 15. The stress relief 300 may also comprise a step 304 from both the overhanging portion 302 and the bottom floor 303, as in the embodiment of FIG. 16.

Figure 17:
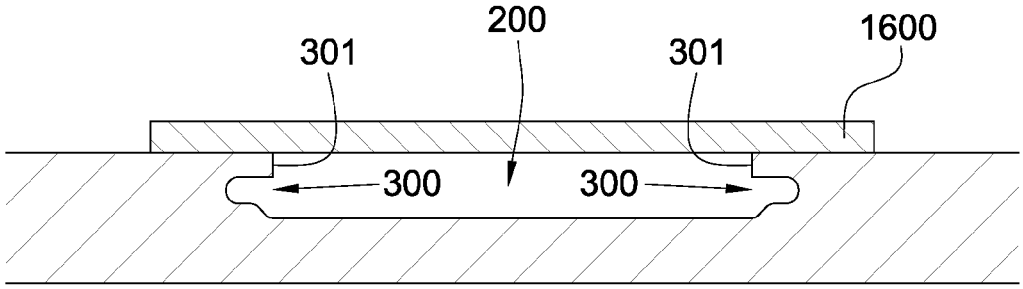
FIG. 17 is a cross-sectional diagram of another embodiment of a pocket in a downhole tool string component.
Figure 18:
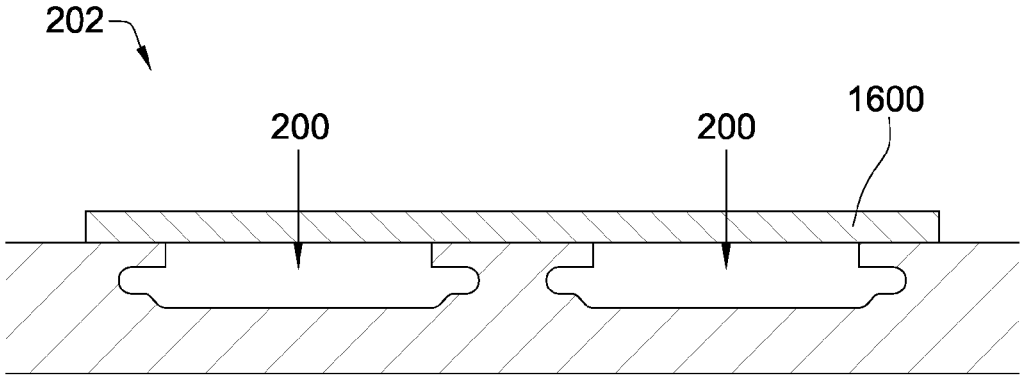
FIG. 18 is a cross-sectional diagram of an embodiment of a plurality of pockets in a downhole tool string component.
Figure 19:
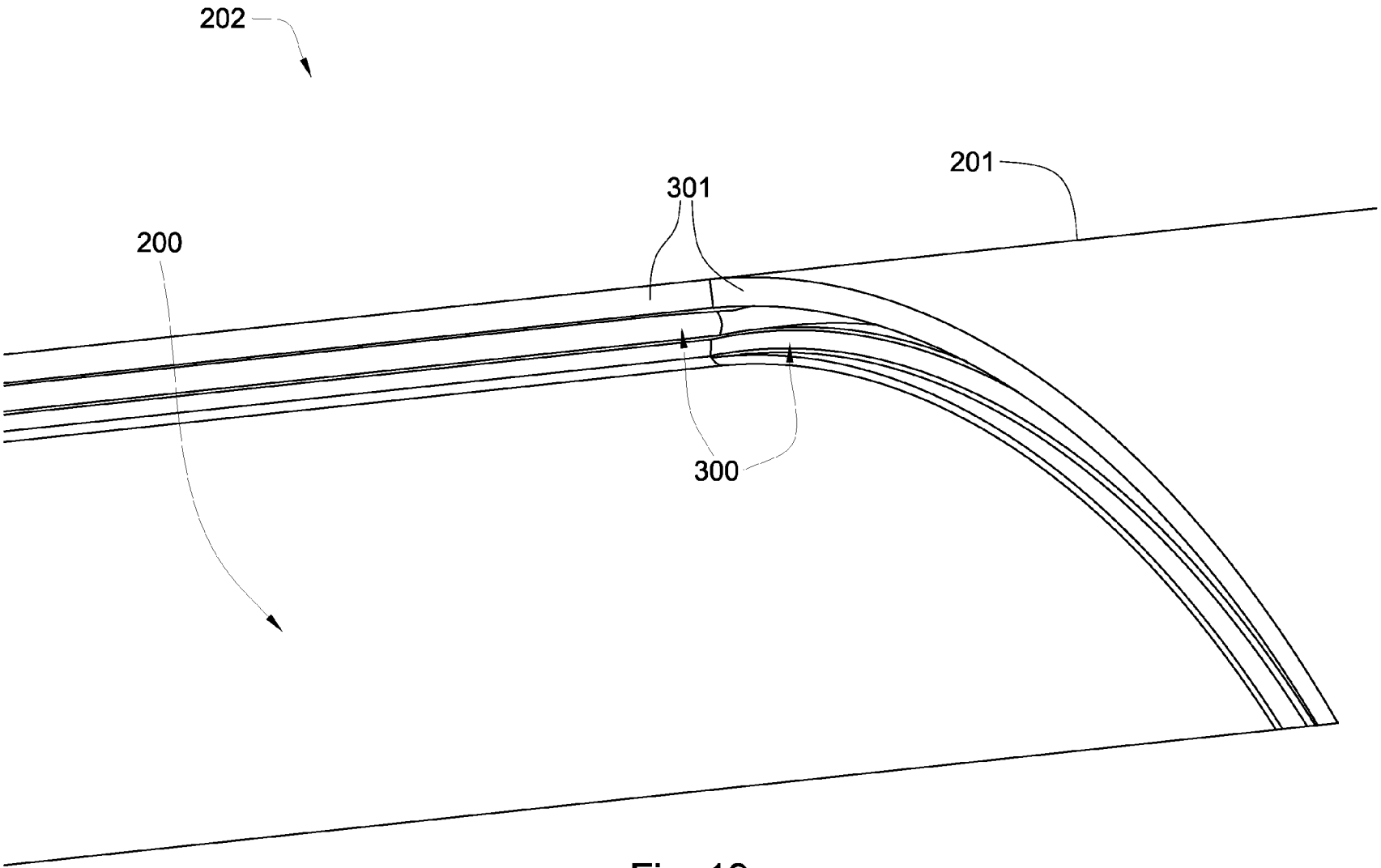
FIG. 19 is a perspective diagram of another embodiment of a pocket in a downhole tool string component.

A plurality of side walls 301 in the pocket 200 may comprise open cavities 300, as in the embodiment of FIG. 17. The covering 1600 may cover a single pocket 200, or a plurality of pockets 200 in a single component 202, as in the embodiment of FIG. 18, though each pocket 200 may be sealed by an individual covering 1600. The downhole instrumentation in each pocket 200 may be in electrical communication with each other. The stress relief 300 may be formed in a plurality of the side walls 301 of the pocket 200, as in the embodiment of FIG. 19, when the pocket 200 does not encompass the entire outer diameter 201 of the component 202.

Whereas the present invention has been described in particular relation to the drawings attached hereto, it should be understood that other and further modifications apart from those shown or suggested herein, may be made within the scope and spirit of the present invention.

What is claimed is:

1. A downhole tool string component, comprising:

a tubular body with an inner and outer diameter;

a pocket formed in the outer diameter being adapted to receive downhole instrumentation;

a covering attached to the outer diameter of the component and adapted to seal the pocket from outside debris, the pocket comprising a bottom floor and a plurality of side walls; and a stress relief formed between at least one overhanging portion of the outer diameter and the bottom floor at the junction of the bottom floor and at least one of the side walls.

2. The component of claim 1, wherein a plurality of stress reliefs are formed in at least one of the side walls.

3. The component of claim 1, wherein the stress relief is formed in a plurality of the side walls.

4. The component of claim 1, wherein a plurality of pockets is formed in the outer diameter and is adapted to receive downhole instrumentation.

5. The component of claim 4, wherein the covering is adapted to seal the plurality of pockets from outside debris.

6. The component of claim 1, wherein the covering is a sleeve disposed around the outer diameter of the tubular body.

7. The component of claim 1, wherein the covering is a plate fastened to the outer diameter of the tubular body.

8. The component of claim 1, wherein the covering comprises a plurality of grooves adapted to stretch and/or flex with the tubular body.

9. The component of claim 1, wherein the stress relief comprises a step with a rounded geometry.

10. The component of claim 1, wherein the stress relief comprises rounded borders.

11. The component of claim 1, wherein the stress relief is generally concave.

12. The component of claim 1, wherein the stress relief comprises a convex portion.

13. The component of claim 1, wherein a portion of the downhole instrumentation is disposed within a volume of the stress relief.

14. The component of claim 1, wherein the stress relief comprises a characteristic of increasing the flexibility of the downhole component.

15. The component of claim 1, wherein the downhole instrumentation is part of a closed-loop system.

16. The component of claim 1, wherein the side walls are sloped.

17. The component of claim 1, wherein a ratio of a depth of the stress relief to a depth of the pocket ranges between 0.2 to 1, and 1.5 to 1.

18. The component of claim 1, wherein the stress relief is filled with a filler material.

19. The component of claim 1, wherein the pocket is annular and encompasses the entire outer diameter of the component.

* * * * *